US005126582A

United States Patent [19]

Sugiyama

[11] Patent Number: 5,126,582

[45] Date of Patent: Jun. 30, 1992

[54] COMBINED ENGINE STARTER/GENERATOR

[75] Inventor: Takeshi Sugiyama, Hyogo, Japan

[73] Assignee: Mitsubishi Denki K.K., Tokyo, Japan

[21] Appl. No.: 789,542

[22] Filed: Nov. 8, 1991

Related U.S. Application Data

[63] Continuation of Ser. No. 567,570, Aug. 16, 1990, abandoned.

[30] Foreign Application Priority Data

Aug. 23, 1989 [JP] Japan ..... 1-216241
Aug. 23, 1989 [JP] Japan ..... 1-216251

[51] Int. Cl.[5] ..... F02N 11/04

[52] U.S. Cl. ..... 290/46; 290/31; 290/22; 74/7 E

[58] Field of Search ..... 74/7 E; 290/22, 31, 290/46

[56] References Cited

U.S. PATENT DOCUMENTS 1,039,685 10/1912 Apple ..... 74/7 E
1,053,909 2/1913 Gray ..... 74/7 E
2,451,767 10/1948 Nardone ..... 290/22
4,459,536 7/1984 Wirtz ..... 322/10
4,862,009 8/1989 King ..... 290/22

FOREIGN PATENT DOCUMENTS 162978 10/1985 Japan .

*Primary Examiner*—A. D. Pellinen
*Assistant Examiner*—Robert Lloyd Hoover
*Attorney, Agent, or Firm*—Sughrue, Mion, Zinn, Macpeak & Seas

[57] ABSTRACT

An engine starter/generator has a rotor which rotates on excitation caused by an exciting winding, a speed reducer which reduces the speed of rotation of the rotor, a first clutch which transmits the rotation of the rotor, the speed of which has been reduced through the speed reducer, to an output shaft of an engine, and a second clutch which is disposed between the engine output shaft and the rotor to connect together these two members when the speed of rotation of the engine output shaft is greater than that of the rotor. The speed reducer and at least either one of the first and second clutches are disposed substantially axially in line with one another. This arrangement reduces the radial dimension of the engine starter/generator. It can, therefore, be disposed with in the engine room of a vehicle without difficulty.

5 Claims, 5 Drawing Sheets

COMBINED ENGINE STARTER/GENERATOR

This is a continuation of application Ser. No. 07/567,570, filed Aug. 16, 1990 now abandoned.

BACKGROUND OF THE INVENTION

1. Field of the Invention

The present invention relates to an engine starter/-generator. More particularly, the present invention relates to a structure for providing connection between a rotor of an engine starter/generator and an engine output shaft.

2. Description of the Related Art

A typical conventional engine starter/generator is disclosed in Japanese Utility Model Public Disclosure (KOKAI) No. 60-162978 (1985). The conventional engine starter/generator generally comprises, as shown in FIG. 5, a rotor 3 including a first rotor member 1*a* and a second rotor member 1*b* connected to the first rotor member 1*a* by a ring 2, a field winding 5 wound around a field core 4 and an armature 6. The boss portion of the first rotor member 1*a* can be engaged with and disengaged from a crankshaft 8 through a first one-way clutch 7. A sun gear 9 is formed on the outer peripheral surface of the boss portion of the first rotor member 1*a*. The sun gear 9 is meshed with a plurality of planet gears 11 which are, in turn, supported on a carrier 10 bolted to the crankshaft 8. The planet gears 11 are also meshed with an internal gear 12. The internal gear 12 can be engaged with and disengaged from a retainer 14 through a second one-way clutch 15. The retainer 14 is rigidly secured to an engine body 13 by a bolt.

The conventional engine starter/generator operates as follows. In the engine starting mode, the speed of rotation of the rotor 3 is reduced through a speed reducer that comprises the planet gears 11, the internal gear 12, etc. (i.e., the second one-way clutch 15 is locked, depending upon the direction of rotation of the planet gears 11, to fix the internal gear 12 in position, causing the carrier 10 to rotate at a reduced speed). As a result, an adequate turning torque is transmitted to the crankshaft 8. At this time, the first one-way clutch 7 overruns or freewheels (i.e., in a disconnected state). After the engine has been started, the second one-way clutch 15 is unlocked whereby the speed reducer no longer acts on the rotor 3. On the other hand, the first one-way clutch 7 is locked so that the rotation of the crankshaft 8 is transmitted directly to the rotor 3 through the first one-way clutch 7. This arrangement prevents the rotor 3 from rotating at an excessive speed.

In the above-described conventional engine starter/-generator, however, the two one-way clutches 7 and 15 and the planet gears 11, which constitute a speed reducer, are arranged radially in line with one another. This results in an increase in the radial dimension of the prior art system. Thus, the prior art system is hardly fit in the engine room of a vehicle.

SUMMARY OF THE INVENTION

In view of the above-described problems of the prior art, it is an object of the present invention to provide an engine starter/generator wherein when the engine is to be started, the rotation of a rotor is transmitted to a crankshaft after the speed has been reduced, and after the engine has been started, the crankshaft and the rotor are connected together to rotate the latter, the engine starter/generator being designed so as to minimize the radial dimension.

To this end, the present invention provides an engine starter/generator comprising: a rotor rotatable by an exciting winding; a speed reducer which reduces the speed of rotation of the rotor; a first clutch which transmits the rotation of the rotor, the speed of which has been reduced through the speed reducer, to an output shaft of an engine; and a second clutch arranged between the engine output shaft and the rotor to connect together these two members when the speed of rotation of the engine output shaft is greater than that of the rotor, wherein the speed reducer and at least either one of the first and second clutches are disposed substantially axially in line with one another.

By virtue of the above-described arrangement of the present invention, when the engine is to be started, the rotation of the rotor is transmitted to the engine output shaft through the speed reducer and the first clutch, so that the engine output shaft is rotated with an adequate turning torque. On the other hand, after the engine has been started, the first clutch is unlocked or disengaged, and the second clutch becomes locked, so that the rotation of the engine output shaft is transmitted to the rotor, not through the speed reducer. Thus, two clutches are provided to give an adequate turning torque to the engine output shaft when the engine is to be started, and to prevent the rotor from rotating at an excessive speed after the engine has been started, and at least one of the two clutches is disposed substantially axially in line with one another, thereby achieving a reduction in the radial dimension of the apparatus.

According to one aspect of the present invention, the first and second clutches are one-way clutches.

According to another aspect of the present invention, the first clutch is a centrifugal clutch, and the second clutch is a one-way clutch. In a case where a centrifugal clutch is employed as the first clutch, when the engine is to be started, the rotation of the rotor is transmitted to the engine output shaft through the speed reducer and the centrifugal clutch, so that the engine output shaft is rotated with an adequate turning torque, in the same way as in the above. On the other hand, after the engine has been started, the centrifugal clutch remains locked until the engine output shaft reaches a predetermined level, and the rotor therefore rotates at an increased speed through the speed reducer, which now functions as an accelerator. When the engine output shaft exceeds the predetermined level, the centrifugal clutch is disconnected to prevent the transmission of power from the engine output shaft to the rotor through the speed reducer. As a result, no rotation is transmitted to the rotor, which has been rotated at a speed increased through the speed reducer, so that the speed of rotation of the rotor gradually decreases, and when the speed of rotation of the rotor becomes less than that of the engine output shaft, the one-way clutch is connected to directly connect the engine output shaft and the rotor.

BRIEF DESCRIPTION OF THE DRAWINGS

The above and other objects, features and advantages of the present invention will become more apparent from the following description of preferred embodiments when taken in conjunction with the accompanying drawings in which.

DESCRIPTION OF THE PREFERRED EMBODIMENTS

Figure 1:
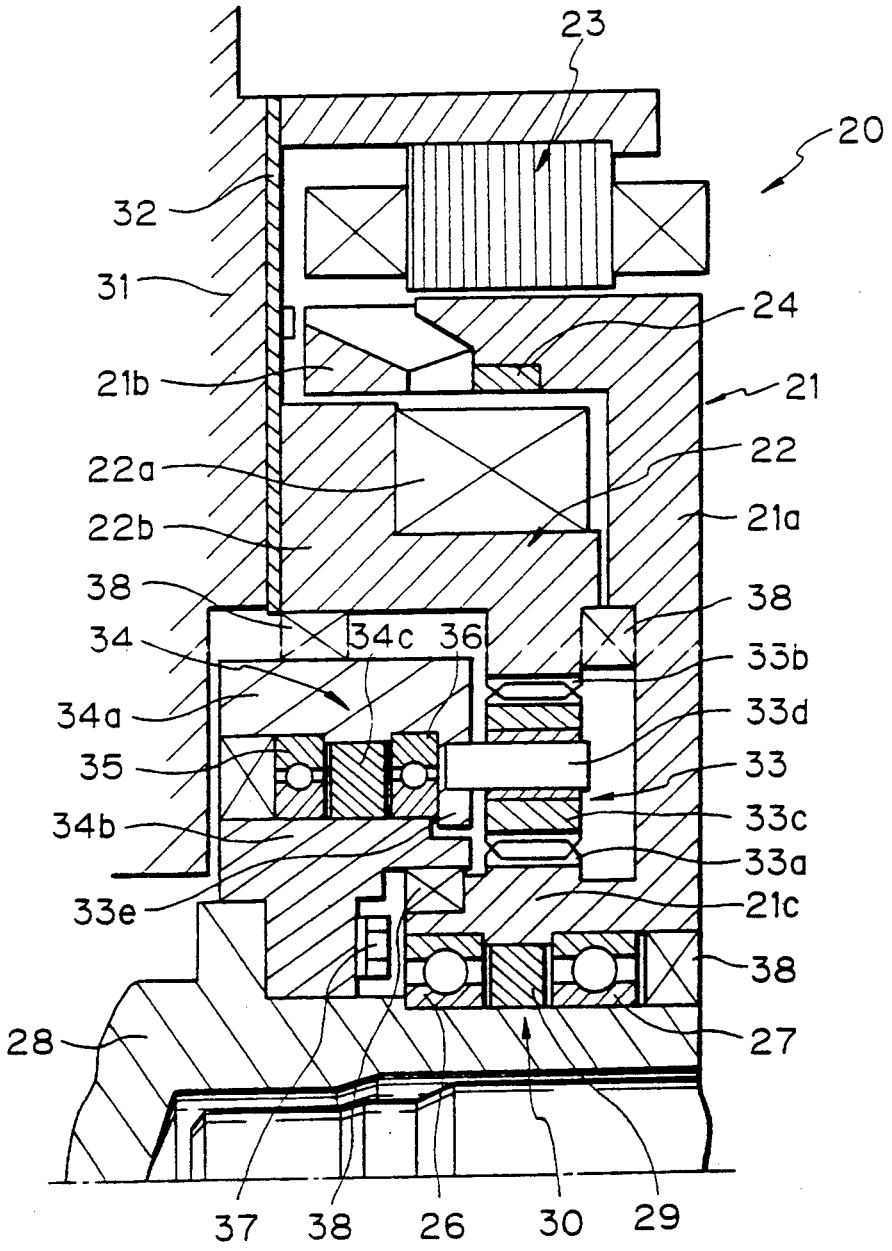
FIG. 1 is a fragmentary sectional view of one embodiment of the engine starter/generator according to the present invention.

Like reference numerals denote like or corresponding elements or components throughout several views of the drawings.

FIG. 1 shows an engine starter/generator 20 according to a first embodiment of the present invention. The engine starter/generator 20 comprises a pair of revolving field poles 21*a*, 21*b*, an exciting winding or a field coil 22*a* and an armature 23. The pair of field poles 21*a* and 21*b*, which are formed from a ferromagnetic material, are interconnected by a ring 24 to constitute a rotor 21. In the rotor 21, a boss portion 21*c* of the revolving field pole 21*a* that also serves as a flywheel is fit around an output shaft (e.g., crankshaft) 28 of an engine through two axially spaced apart bearings 26 and 27. The inner peripheral surface of the boss portion 21*c* is formed with wedge-shaped cam surfaces, and rollers 29 are disposed within wedge-shaped spaces defined by the cam surfaces. More specifically, the boss portion 21*c* of the revolving field pole 21*a*, the roller 29 and the output shaft 28 together constitute an overrunning clutch 30. The boss portion 21*c* serves as a clutch outer member, and the output shaft 28 serves as a clutch inner member. The direction of the cam surfaces of the overrunning clutch 30 is set so that, when the speed of rotation in a predetermined direction of the boss portion 21*c* as the clutch outer member, is greater than that of the output shaft 28 as the clutch inner member, the clutch 30 overruns or freewheels. On the contrary, when the former is less than the latter, the clutch 30 becomes locked or engaged.

The field coil 22*a*, which excites the field poles 21*a* and 21*b*, is wound on a field core 22*b* in a direction circumferentially of the output shaft 28 to form a stator 22. The field core 22*b* is secured to a cylinder block 31 of the engine through a rear plate 32.

The boss portion 21*c* of the revolving field pole 21*a* has a sun gear 33*a* formed on the outer peripheral surface thereof. An internal gear 33*b* is formed on the inner peripheral surface of the stator 22. A plurality of planet gears 33*c* are meshed with these gears 33*a* and 33*b*. Each planet gear 33*c* is supported by a support shaft 33*d* that is secured at one end to a carrier 33*e* or a flange extending radially inward from a tubular member 34*a*. The tubular member 34*a* extends axially in line with the planet gears 33*c*. The sun gear 33*a*, the internal gear 33*b*, the planet gears 33*c*, the support shafts 33*d* and the carrier 33*e* together constitute a planetary gear assembly or speed reducer 33.

The tubular member 34*a*, which is integral with the flange or the carrier 33*e*, also constitutes a clutch outer member of another overrunning clutch 34. A clutch inner member 34*b* is fit within the tubular member 34*a* through two bearings 35 and 36 which are, in turn, arranged in an axially spaced relation. Rollers 34*c* are disposed within wedge-shaped spaces between the bearings 35 and 36. The clutch inner member 34*b* is secured to the output shaft 28 by means of a bolt 37. The direction of the wedge-shaped cam surfaces of the overrunning clutch 34 is set so that, when the speed of rotation in a predetermined direction of the tubular member 34*a* as the clutch outer member, is greater than that of the clutch inner member 34*b* coupled to the output shaft 28, the clutch 34 becomes locked or engaged. On the other hand, when the latter is greater than the former, the clutch 34 overruns or freewheels.

It should be noted that reference numeral 38 in FIG. 1 denotes oil seals.

In actual use of the engine starter/generator 20 according to the first embodiment arranged as described above, in the engine starting mode, the rotor 21 is active to rotate the planet gears 33*c* around the sun gear 33*a*. This causes the tubular member 34*a* to rotate at a reduced speed. Since, at this time, the speed of rotation of the clutch outer member or the tubular member 34*a* is greater than that of the clutch inner member 34*b*, the overrunning clutch 34 becomes locked or engaged. As a result, the rotation of the tubular member 34*a* is transmitted to the clutch inner member 34*b* and thus, the output shaft 28. On the other hand, the overrunning clutch 30 overruns or freewheels since, at this time, the speed of rotation of the clutch outer member or the boss portion 21*c* is greater than that of the clutch inner member or the output shaft 28.

After the engine has been started, the speed of rotation of the output shaft 28 reaches or exceeds that of the rotor 21. The overrunning clutch 30 then becomes locked or engaged so as to connect the output shaft 28 and the rotor 21 together. On the other hand, the overrunning clutch 34 overruns since the clutch inner member 34*b* rotates at a much higher speed than that of the tubular member 34*a*. Consequently, the speed of the rotor 21 will no longer be increased by the speed reducer.

According to the engine starter/generator of the first embodiment, in the engine starting mode, the speed of rotation of the rotor 21 is reduced in order to provide an adequate turning torque to the output shaft 28 of the engine. After the engine has been started, the reverse transmission of rotational force through the speed reducer 33 is prevented, and the rotor 21 and the output shaft 28 are connected together to prevent the rotor 21 from rotating at an excessive speed. For this purpose, the two overrunning clutches 30 and 34 are provided, and the tubular member 34*a*, which serves as the clutch outer member of one of the two, that is, the overrunning clutch 34, is disposed axially in line with the planet gears 33*c*. This avoids considerable increase in the radial dimension of the engine starter/generator 20 despite the installation of the two overrunning clutches 30, 34 and the speed reducer 33. It is, therefore, possible to dispose the engine starter/generator 20 within the engine room of a vehicle without difficulty.

Figure 2:
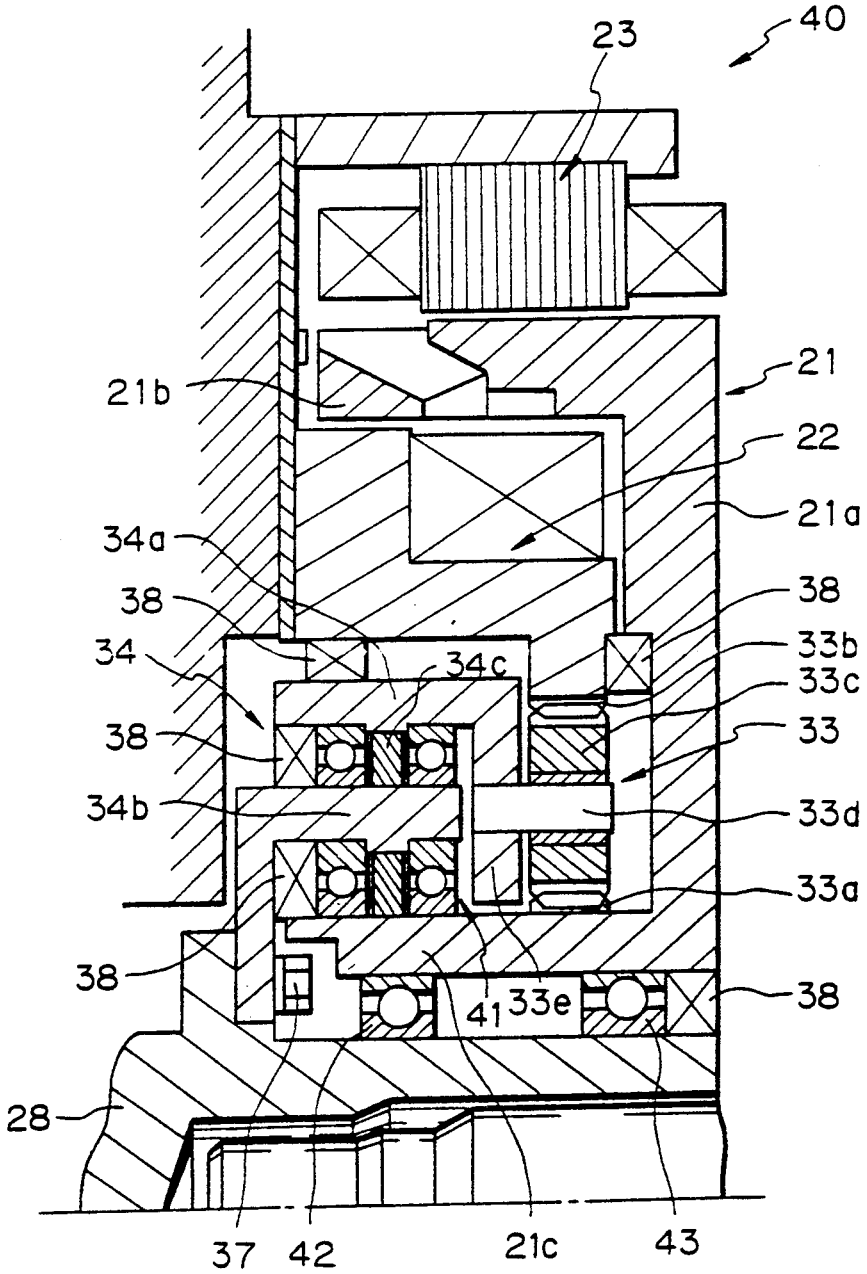
FIG. 2 is a fragmentary sectional view of another embodiment of the engine starter/generator according to the present invention.

FIG. 2 shows an engine starter/generator 40 according to a second embodiment of the present invention.

In the engine starter/generator 40 of the second embodiment, an overrunning clutch 41 is arranged radially inwardly of the overrunning or one-way clutch 34 so as to provide connection between the output shaft 28 and the rotor 21. More specifically, the boss portion 21*c* of the revolving field pole 21*a* is fit around the output shaft 28 through two bearings 42 and 43. The overrunning clutch 41 employs the boss portion 21*c* as a clutch inner member. The clutch inner member 34*b* of the overrunning clutch 34 also serves as a clutch outer member for the overrunning clutch 41. In this case, the overrunning clutch 41 becomes locked or engaged when the speed of rotation in a predetermined direction of the clutch outer member (secured to the output shaft 28) is greater than that the clutch inner member or the boss portion 21*c*. On the other hand, when the latter is greater than the former, the overrunning clutch 41 overruns. As to the two overrunning clutches 34 and 41, in the engine starting mode, the clutch inner member 34*b* of the overrunning clutch 34 always rotates at a lower speed than that of the rotor 21 through the speed reducer 33. Accordingly, the speed of rotation of the clutch inner member of the overrunning clutch 41, that is, the boss portion 21*c* of the rotor 21, is always greater than that of the clutch inner member 34*b* of the overrunning clutch 34, which also serves as the clutch outer member of the overrunning clutch 41. Therefore, the overrunning clutch 41 overruns or freewheels, as described above.

As has been described above, in the engine starting mode, the speed of rotation of the rotor 21 is reduced in order to transmit an adequate turning torque to the output shaft 28 of the engine. After the engine has been started, the reverse transmission of rotational force through the speed reducer is prevented, and the rotor and the output shaft are connected together to prevent the rotor from rotating at an excessive speed. At least one of the two overrunning clutches is disposed axially in line with the speed reducer. Accordingly, the radial dimension of the engine starter/generator is reduced, so that the engine starter/generator can be disposed within the engine room of a vehicle without difficulty.

Figure 3:
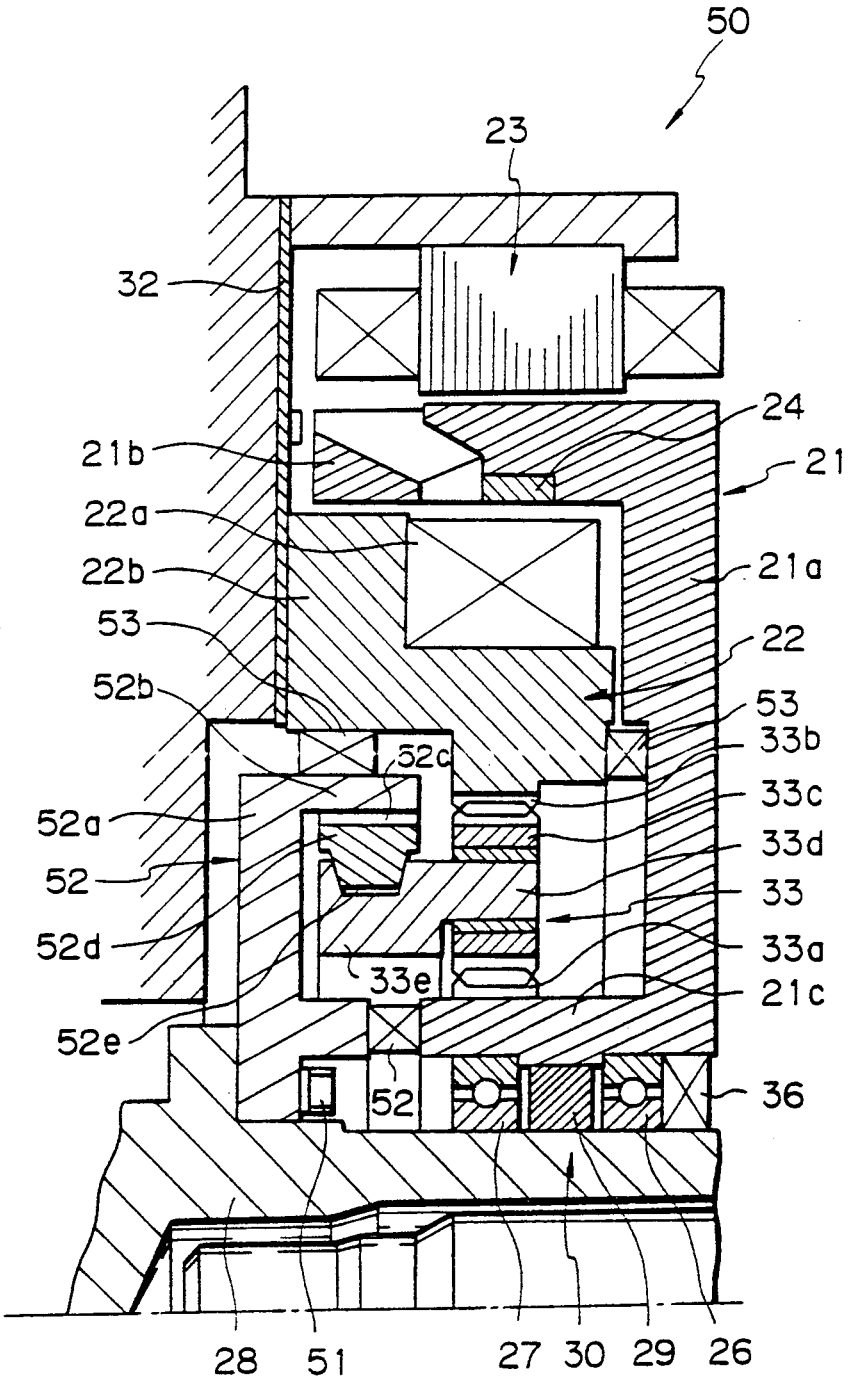
FIG. 3 is a fragmentary sectional view of still another embodiment of the engine starter/generator according to the present invention.

FIG. 3 shows an engine starter/generator 50 according to a third embodiment of the present invention.

A tubular member or carrier 33*e* is disposed within a drum 52*a* with a U-shaped cross section which is, in turn, secured to the engine output shaft 28 by a bolt 51. A plurality of weights 52*d* are supported inside a peripheral wall 52*b* of the drum 52*a*, the weights 52*d* being biased radially inward by respective springs 52*c*. The weights 52*d* are thus fit into respective grooves 52*e* with an inverted trapezoidal cross section which are formed in the outer peripheral surface of the tubular member or the carrier 33*e*, so that the carrier 33*e* and the drum 52*a* are frictionally connected together. When the speed of rotation of the engine output shaft 28 exceeds a predetermined level, the weights 52*d* are moved radially outwardly against the action of the springs 52*c* by the centrifugal force and then disengaged from the grooves 52*e*. The carrier 33*e* is thus disconnected from the drum 52*a*. As will be clear, the drum 52*a*, the peripheral wall 52*b*, the springs 52*c*, the weights 52*d*, the carrier 33*e* of the speed reducer 33 and the grooves 52*e* together constitute a centrifugal clutch 52.

It should be noted that reference numeral 53 in FIG. 3 denotes oil seals suitably disposed within the system.

The operation of the engine starter/generator 50 of this embodiment will next be explained with reference to FIG. 3. When the rotor 21 is rotated to start the engine, the planet gears 33*c* also revolve around the sun gear 33*a*, and the carrier 33*e* is therefore rotated at a reduced speed. Since, at this time, the weights 52*d* are fit in the grooves 52*e* in the outer peripheral surface of the carrier 33*e* under the action of the springs 52*c*, the centrifugal clutch 52 connects the carrier 33*e* and the drum 52*a* together to transmit rotation of the carrier 33*e*, at a reduced speed, to the engine oupput shaft 28. On the other hand, the overrunning clutch 30 overruns since, at this time, the speed of rotation of the clutch outer member or the boss portion 21*c* is always greater than that of the clutch inner member or the output shaft 28.

After the engine has been started, the rotation of the output shaft 28 is transmitted to the rotor 21 through the centrifugal clutch 52 and the speed reducer 33. Since, at this time, the speed reducer 33 functions as an accelerator, the rotor 21 rotates at a higher speed than that of the engine output shaft 28. Therefore, the overrunning clutch 30 still overruns. In other words, the rotor 21 can be rotated at a high speed while the output shaft 28 is rotating at an engine idle or low speed. It is, therefore, possible to generate sufficient electric power.

Figure 4:
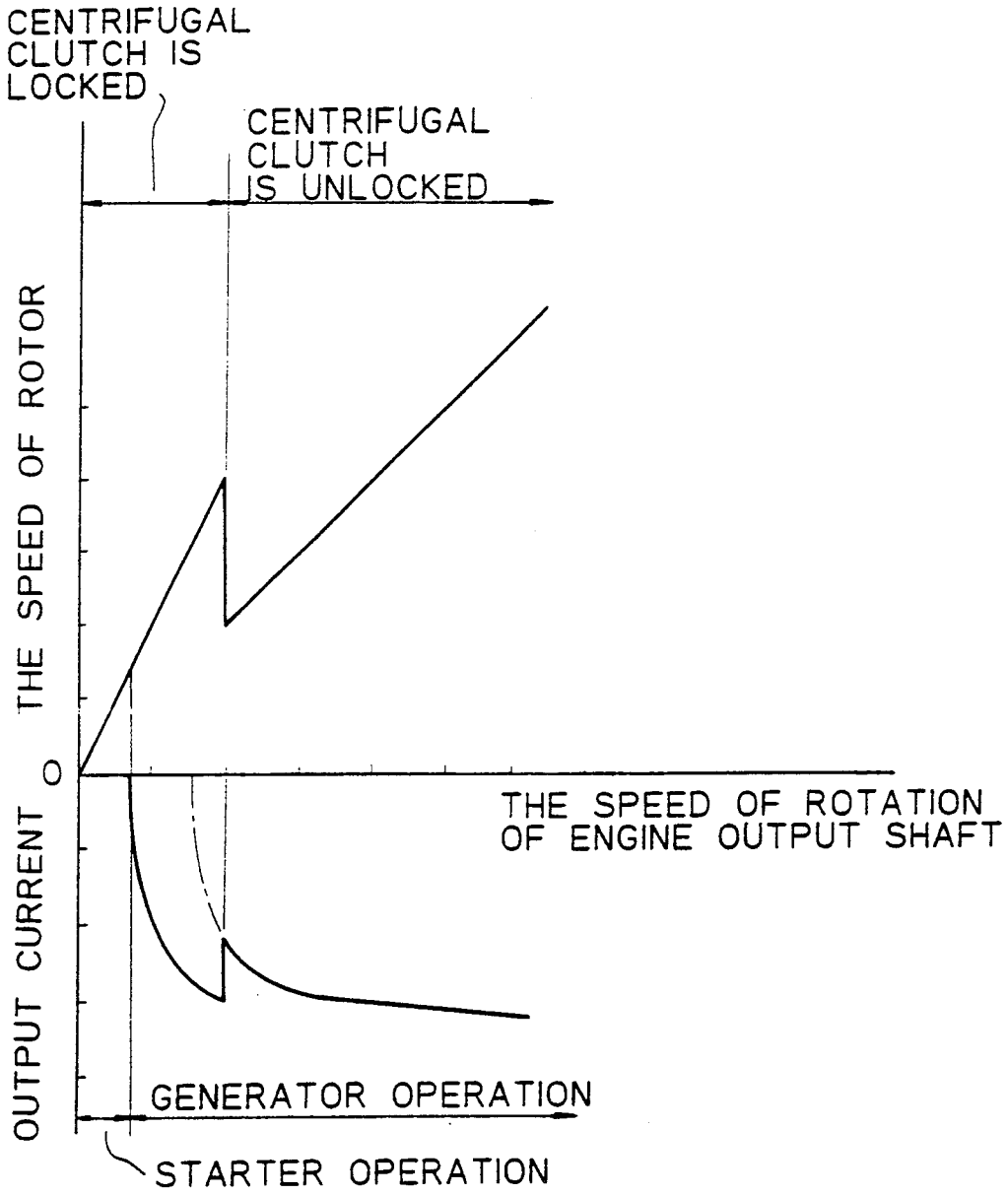
FIG. 4 are graphs showing rotational speed of a rotor vs. that of an engine output shaft and output current during operation of the engine shown in FIG. 3.

When the speed of rotation of the engine output shaft 28 reaches a predetermined level, the weights 52*d* are moved radially outwardly against the action of the springs 52*c* by the centrifugal force and disengaged from the grooves 52*e*. As a result, the rotation of the drum 52*a* is no longer transmitted to the carrier 33*e*, and the centrifugal clutch 52 is locked. Thus, the speed of rotation of the rotor 21 decreases as shown in FIG. 4. When it becomes less than the speed of rotation of the engine output shaft 28, the overrunning clutch 30 becomes locked or engaged so that the engine output shaft 28 is connected to the rotor 21.

Again, even after the engine has been started, the speed reducer 33 is utilized as an accelerator to rotate the rotor 21 at a high speed until the engine output shaft 28 reaches a predetermined level. The rotor 21 is thereafter connected to the engine output shaft 28.

Figure 5:
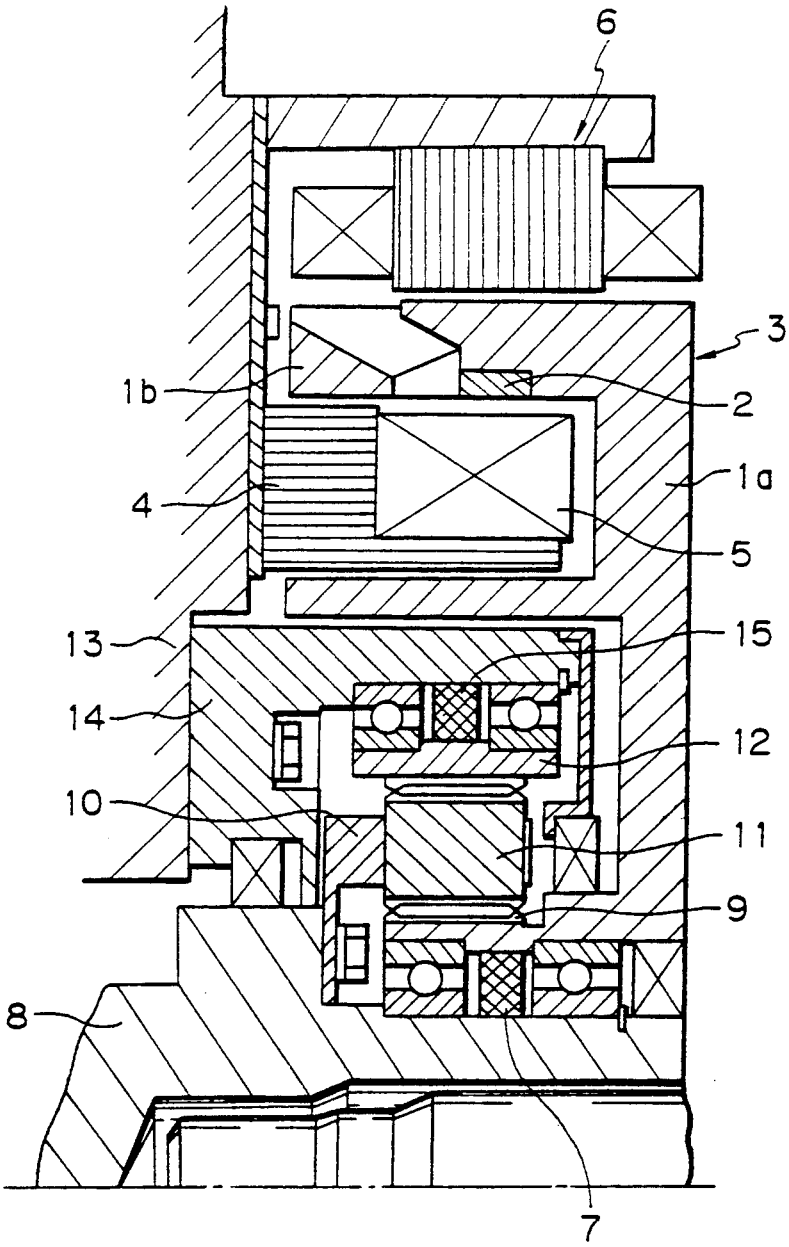
Fig. 5 PRIOR ART
FIG. 5 is a fragmentary sectional view of a conventional engine starter/generator.

This arrangement permits the instant system to generate greater electrical power than the conventional system (FIG. 5) as shown in FIG. 4 and prevents the rotor 21 from rotating at an excessive or undersirable speed.

As has been described above, in the third embodiment, at least one of the clutches and the speed reducer are disposed axially in line with one another. It is, therefore, possible to reduce the radial dimension of the engine starter/generator. In addition, when the engine is to be started, the rotation of the rotor is transmitted to the engine output shaft after the speed has been reduced. An adequate starting torque can therefore be obtained. In the engine idle mode, the speed of rotation of the rotor 21 is increased by the speed reducer, acting as an accelerator, until the speed or rotation of the engine output shaft reaches a predetermined level. During this period of time, the engine starter/generator can generate sufficient electrical power. After the speed of rotation of the engine shaft has reached the predetermined level, the speed of rotation of the rotor becomes equal to that of the engine output shaft.

This arrangement ensures the strength and durability of the instant system. The present system efficiently and effectively functions as an engine starter and a generator.

Although the present invention has been described through specific terms, it should be noted that the described embodiments are not necessarily exclusive and that various changes and modifications may be imparted thereto without departing from the scope of the invention which is limited solely by the appended claims.

What is claimed is:

1. An engine starter/generator comprising:

first and second rotatable members;

speed reducing means for reducing the speed of rotation of said first rotatable member, said speed reducing means comprising planetary gears, a support shaft supporting said planetary gears, and a carrier member having said support shaft secured thereto;

a first clutch disposed between said first and second rotatable members and adapted to transmit rotation of said first rotatable member, at a reduced speed, to said second rotatable member, said first clutch including a tubular member integrally formed with said carrier member; and a second clutch disposed between said first and second rotatable members adapted to provide a driving connection between said first and second rotatable members when the speed of rotation of said second rotatable member exceeds that of said first rotatable member;

said first rotatable member, said speed reducing means, said first clutch, and said second clutch being disposed around said second rotatable member, and said speed reducing means and at least one of said first and second clutches being disposed substantially in axial alignment with one another, wherein said tubular member is axially aligned with said planetary gears of said speed reducing means, and wherein said support shaft is secured to said first clutch.

2. An engine starter/generator according to claim 1 wherein said first rotatable member includes a boss disposed around said second rotatable member, and wherein said second clutch comprises an overrunning clutch disposed between said boss of said first rotatable member and said second rotatable member, said boss and said second rotatable member serving as a clutch outer member and a clutch inner member, respectively, and wherein said first clutch comprises an overrunning clutch adapted to provide a driving connection between said first rotatable member and said second rotatable member through said speed reducing means when the speed of rotation of said first rotatable member is greater than that of said second rotatable member and adapted to overrun when the speed of rotation of said second rotatable member exceeds that of said first rotatable member.

3. An engine starter/generator according to claim 1 wherein said first clutch comprises a centrifugal clutch, and said second clutch comprises an overrunning clutch.

4. An engine starter/generator comprising:

a rotor including a boss;

an engine output shaft around which said rotor is rotated;

reduction gear means disposed between said rotor and said engine output shaft for reducing the speed of rotation of said rotor, said reduction gear means comprising planetary gears, a support shaft supporting said plantary gears, and a carrier member having said support shaft secured thereto;

first clutch means for transmitting rotation of said rotor, at a reduced speed, to said engine output shaft when the speed of rotation of said rotor is greater than that of said engine output shaft, said first clutch means including a tubular member integrally formed with said carrier member; and second clutch means disposed between said boss and said engine output shaft for providing a driving connection between said engine output shaft and said rotor when the speed of rotation of said engine output shaft exceeds that of said rotor and adapted to overrun when the speed of rotation of said rotor is greater than that of said engine output shaft;

said rotor, said reduction gear means, said first clutch means and said second clutch means being disposed radially around said engine output shaft, and said reduction gear means and at least one of said first and second clutch means being disposed substantially in axial alignment with one another, wherein said tubular member is axially aligned with said plantetary gears of said speed reducing means, and wherein said support shaft is secured to said first clutch.

5. An engine starter/generator according to claim 4 wherein said reduction gear means and said first clutch means are arranged axially in a side-by-side relation.

* * * * *